US012226023B2

(12) United States Patent
Zhang

(10) Patent No.: US 12,226,023 B2
(45) Date of Patent: Feb. 18, 2025

(54) EASILY ASSEMBLED CHAIR WITH REDUCED PACKAGING AREA

(71) Applicant: Anji Hengjian Smart Home Technology Co., Ltd., Huzhou (CN)

(72) Inventor: Hongxiang Zhang, Huzhou (CN)

(73) Assignee: Anji Hengjian Smart Home Technology Co., Ltd., Huzhou (CN)

( * ) Notice: Subject to any disclaimer, the term of this patent is extended or adjusted under 35 U.S.C. 154(b) by 109 days.

(21) Appl. No.: 17/902,057

(22) Filed: Sep. 2, 2022

(65) Prior Publication Data

US 2024/0041211 A1 Feb. 8, 2024

(30) Foreign Application Priority Data

Aug. 3, 2022 (CN) ..... 202222066683.3

(51) Int. Cl.
*A47C 4/02* (2006.01)
*A47C 5/10* (2006.01)
*A47C 7/42* (2006.01)

(52) U.S. Cl.
CPC ..... *A47C 4/02* (2013.01); *A47C 4/021* (2013.01); *A47C 4/024* (2013.01); *A47C 4/028* (2013.01); *A47C 5/10* (2013.01); *A47C 7/42* (2013.01)

(58) Field of Classification Search
CPC .. A47C 4/02; A47C 4/028; A47C 3/04; A47C 5/10; A47C 7/42
USPC ..... 297/440.1, 440.14, 440.15, 440.16, 297/440.23
See application file for complete search history.

(56) References Cited

U.S. PATENT DOCUMENTS

| | | | | | |
|---|---|---|---|---|---|
| 622,297 | A * | 4/1899 | Terlinden | A47C 4/02 | 297/440.16 |
| 753,034 | A * | 2/1904 | Behn | A47C 4/02 | 108/156 |
| 1,233,625 | A * | 7/1917 | Wanner | A47C 4/02 | 297/452.18 |
| 1,480,905 | A * | 1/1924 | Israel | A47C 3/00 | 248/188 |
| 1,711,959 | A * | 5/1929 | Morin | A47C 4/02 | 297/447.4 |
| 2,709,485 | A * | 5/1955 | Haven | A47C 4/03 | 403/217 |
| 3,329,383 | A * | 7/1967 | Pilliod | F16B 12/48 | 403/231 |

(Continued)

FOREIGN PATENT DOCUMENTS

FR 2596970 A1 * 4/1986

*Primary Examiner* — Robert Canfield
(74) *Attorney, Agent, or Firm* — Thomas | Horstemeyer, LLP

(57) ABSTRACT

Disclosed is a chair. The chair may include: a seat component, a first mounting part is provided at a lower portion of the seat component, and a second mounting part is provided at a rear portion of the seat component; a backrest component, a third mounting part is provided at a front side of a lower portion of the backrest component, a fourth mounting part is provided at a bottom side of the lower portion of the backrest component, and the backrest component is detachably mounted to the rear portion of the seat component through mutual cooperation of the second mounting part and the third mounting part; and a plurality of supporting leg components, a fifth mounting part is provided at an upper portion of the supporting leg component.

13 Claims, 6 Drawing Sheets

(56) References Cited

U.S. PATENT DOCUMENTS

| | | | | | |
|---|---|---|---|---|---|
| 3,443,530 | A | * | 5/1969 | Carlson | A47B 13/021<br>248/188.91 |
| 3,467,434 | A | * | 9/1969 | Barker | A47C 4/03<br>297/448.1 |
| 4,563,040 | A | * | 1/1986 | Alster | A47C 4/03<br>297/440.1 |
| 4,577,906 | A | * | 3/1986 | Hsiung | A47C 4/028<br>297/440.18 |
| 4,691,965 | A | * | 9/1987 | Hsiung | A47C 3/00<br>297/440.1 |
| 4,919,485 | A | * | 4/1990 | Guichon | A47C 4/02<br>297/440.15 |
| 6,017,092 | A | * | 1/2000 | Lee | A47C 4/024<br>248/188 |

* cited by examiner

EASILY ASSEMBLED CHAIR WITH REDUCED PACKAGING AREA

CROSS-REFERENCE TO RELATED APPLICATION

This application is filed on the basis of Chinese patent application No. 202222066683.3 filed Aug. 3, 2022, and claims priority to the Chinese patent application, the entire contents of which are incorporated herein by reference.

TECHNICAL FIELD

The present disclosure relates to the technical field of furniture, and more particularly, to a chair.

BACKGROUND

With the development of e-commerce, people's shopping style has also changed. For example, people may buy furniture such as desks and chairs online. Taking the chairs as an example, in order to reduce packaging volumes and logistics costs, the chairs are usually packaged in a disassembled state, and then installed after customers receive the chairs. However, in the actual packaging process, the existing detachable chairs still have the problems of large packaging areas. In addition, in the process of self-assembling by the customers, there is still a problem that a mounting effect is quite different due to the complex structures.

SUMMARY

The present disclosure aims at least addressing one of the problems in the prior art to some extent. Therefore, the present disclosure provides a chair which can reduce a packaging area in a disassembled state, and the assembly is easy.

A chair according to a first aspect of the present disclosure comprises: a seat component, wherein a first mounting part is provided at a lower portion of the seat component, and a second mounting part is provided at a rear portion of the seat component; a backrest component, wherein a third mounting part is provided at a front side of a lower portion of the backrest component, a bottom side of the lower portion of the backrest component is provided with a fourth mounting part, and the backrest component is detachably mounted to the rear portion of the seat component through mutual cooperation of the second mounting part and the third mounting part; and a plurality of supporting leg components, wherein an upper portion of the supporting leg component is provided with a fifth mounting part, one part of the plurality of supporting leg components is detachably mounted to the seat component through mutual cooperation of the fifth mounting part and the first mounting part, and another part of the plurality of supporting leg components is detachably mounted to the backrest component through mutual cooperation of the fifth mounting part and the fourth mounting part.

The chair according to a first aspect of the present disclosure has the following beneficial effects: reducing the packaging area in the disassembled state, and the assembly being easy.

In some embodiments, the first mounting part comprises a first mounting seat, and the fifth mounting part comprises a mounting boss; a first mounting hole is provided at one of the first mounting seat or the mounting boss, a first mounting bolt is provided at the other of the first mounting seat or the mounting boss, and the first mounting bolt is mounted to the first mounting hole.

In some embodiments, the first mounting seat is provided with a first positioning hole, and the mounting boss is cylindrical and is accommodated in the first positioning hole.

In some embodiments, the first mounting hole and the first positioning hole are coaxially arranged in the first mounting seat, and the first mounting bolt is arranged at the mounting boss and coaxial with the mounting boss.

In some embodiments, the first mounting part further comprises a first threaded seat, the first threaded seat is coaxially provided with a threaded hole serving as the first mounting hole, and the first threaded seat is embedded into the first positioning hole; the fifth mounting part comprises a second threaded seat, the second threaded seat is coaxially provided with a screw serving as the first mounting bolt, and the second threaded seat is embedded in the mounting boss; and, when the mounting boss is accommodated in the first positioning hole, an end face of the first threaded seat is attachable to an end face of the second threaded seat.

In some embodiments, the second mounting part comprises a plurality of through holes arranged at the rear portion of the seat component; the third mounting part comprises a plurality of second mounting holes arranged in front of the lower portion of the backrest component; and the chair further comprises a plurality of second mounting bolts, the second mounting bolts pass through the through holes and are mounted to the second mounting holes, so that the backrest component is mounted to the rear portion of the seat component.

In some embodiments, a mounting cavity is formed at the rear portion of the seat component, and at least part of the lower portion of the backrest component is clamped in the mounting cavity.

In some embodiments, a mounting groove is provided at the lower portion of the backrest component, and the backrest component is clamped in the mounting cavity through the mounting groove.

In some embodiments, the fourth mounting part comprises a second mounting seat arranged at the lower portion of the backrest component, and the fifth mounting part comprises a mounting boss; and a third mounting hole is provided at one of the second mounting seat or the mounting boss, and the other is embedded with a third mounting bolt, and the third mounting bolt is mounted to the third mounting hole.

In some embodiments, the second mounting seat is provided with a second positioning hole, and the mounting boss is cylindrical and is accommodated in the second positioning hole.

In some embodiments, the third mounting hole and the second positioning hole are coaxially arranged in the second mounting seat, and the third mounting bolt is embedded in the mounting boss and coaxial with the mounting boss.

A chair according to a second aspect of the present disclosure comprises: a seat component, wherein a first mounting part is provided at a lower portion of the seat component, and a second mounting part is provided at a rear portion of the seat component; a backrest component, wherein a third mounting part is provided at a front side of a lower portion of the backrest component, and the backrest component is detachably mounted to the rear portion of the seat component through mutual cooperation of the second mounting part and the third mounting part; and a plurality of supporting leg components, wherein a fifth mounting part is provided at an upper portion of the supporting leg component portion, and the plurality of the supporting leg components are detachably mounted to the seat component through mutual cooperation of the fifth mounting part and the first mounting part.

The chair according to the second aspect of the present disclosure has the following beneficial effects: reducing the packaging area in the disassembled state, and the assembly being easy.

Figure 1:
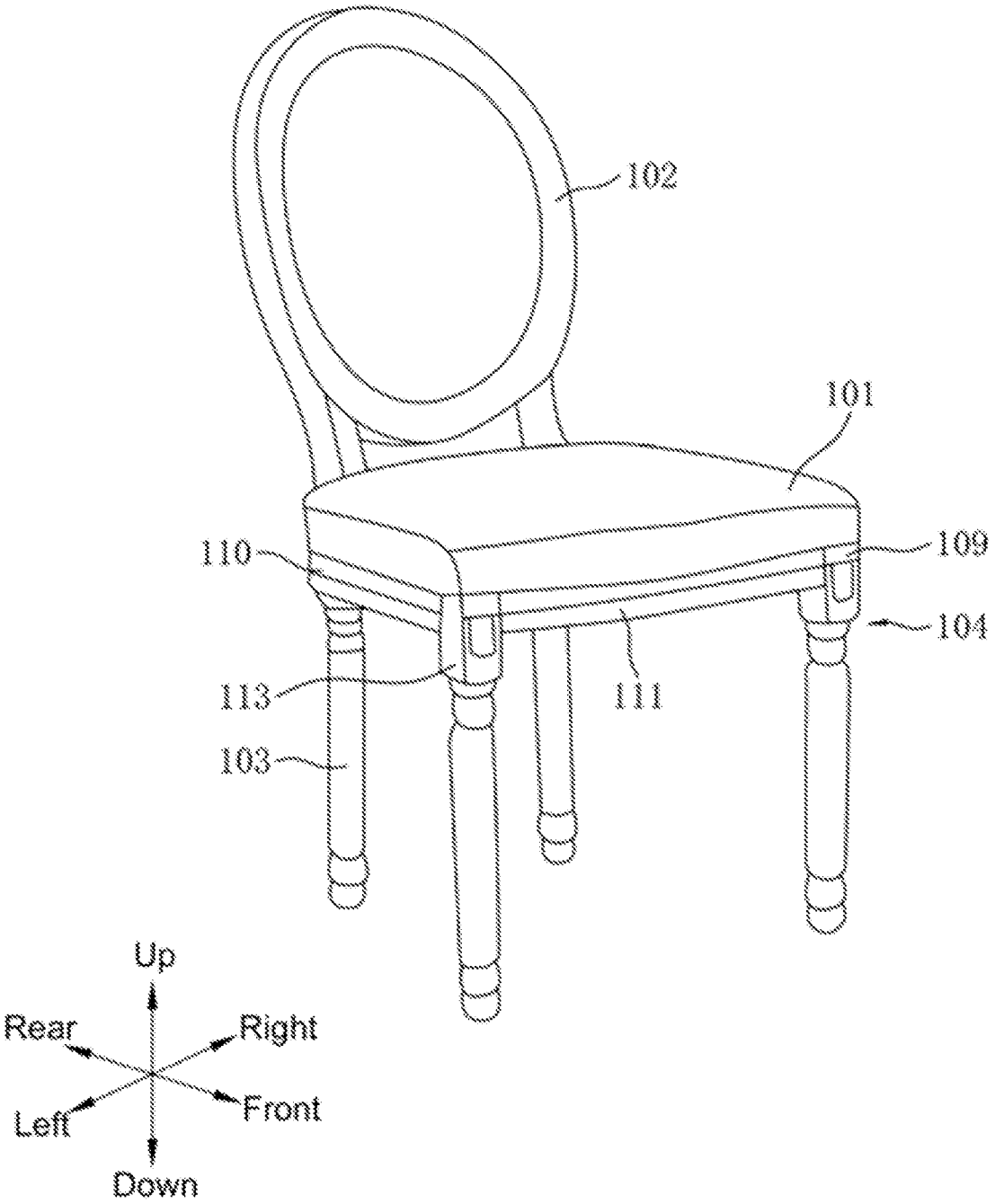
FIG. 1 is a schematic diagram of an embodiment of a chair of the present disclosure.

REFERENCE NUMERALS refers to seat component; 102 refers to backrest component; 103 refers to supporting leg component; 104 refers to first mounting part; 105 refers to second mounting part; 106 refers to third mounting part; 107 refers to fourth mounting part; 108 refers to fifth mounting part; 109 refers to support rod; 110 refers to first connecting rod; 111 refers to second connecting rod; 112 refers to third connecting rod; 113 refers to first mounting seat; 113*a* refers to second lower end face; 114 refers to mounting cavity; 115 refers to reinforcing block; 116 refers to body; 117 refers to upright column; 117*a* refers to third lower end face; 118 refers to fourth connecting rod; 119 refers to mounting boss; 120 refers to first mounting hole; 121 refers to first mounting bolt; 122 refers to first positioning hole; 123 refers to first threaded seat; 123*a* refers to first lower end face; 124 refers to second threaded seat; 124*a* refers to upper end face; 125 refers to through hole; 126 refers to second mounting hole; 127 refers to second mounting bolt; 128 refers to mounting groove; 128*a* refers to lower interior face; and 129 refers to second mounting seat.

DETAILED DESCRIPTION

The embodiments of the present disclosure will be described in detail hereinafter. Examples of the embodiments are shown in the accompanying drawings. The same or similar reference numerals throughout the drawings denote the same or similar elements or elements having the same or similar functions. The embodiments described below with reference to the accompanying drawings are exemplary and are only intended to explain the present disclosure, but should not be construed as limiting the present disclosure.

In the description of the embodiments, it should be understood that the orientation or position relationship related to the orientation description, such as the orientation or position relationship indicated by upper, lower, front, rear, left, right, etc., is based on the orientation or position relationship shown in the drawings, which is only used for convenience of description of the embodiments and simplification of description instead of indicating or implying that the indicated device or element must have a specific orientation, and be constructed and operated in a specific orientation, and thus shall not be understood as a limitation to the embodiments.

In the description of the embodiments, the meaning of several refers to be one or more, and the meaning of multiple refers to be more than two. The meanings of greater than, less than, more than, etc., are understood as not including this number, while the meanings of above, below, within, etc., are understood as including this number. If there is a description to the first and second, it is only for the purpose of distinguishing technical features, and shall not be understood as indicating or implying relative importance, implicitly indicating the number of the indicated technical features or implicitly indicating the order of the indicated technical features.

In the description of the embodiments, unless otherwise explicitly defined, words such as setting, mounting and connecting should be understood a broad sense, and those skilled in the art can reasonably determine the specific meanings of the above words in the embodiments in combination with the specific contents of the technical solutions.

Figure 2:
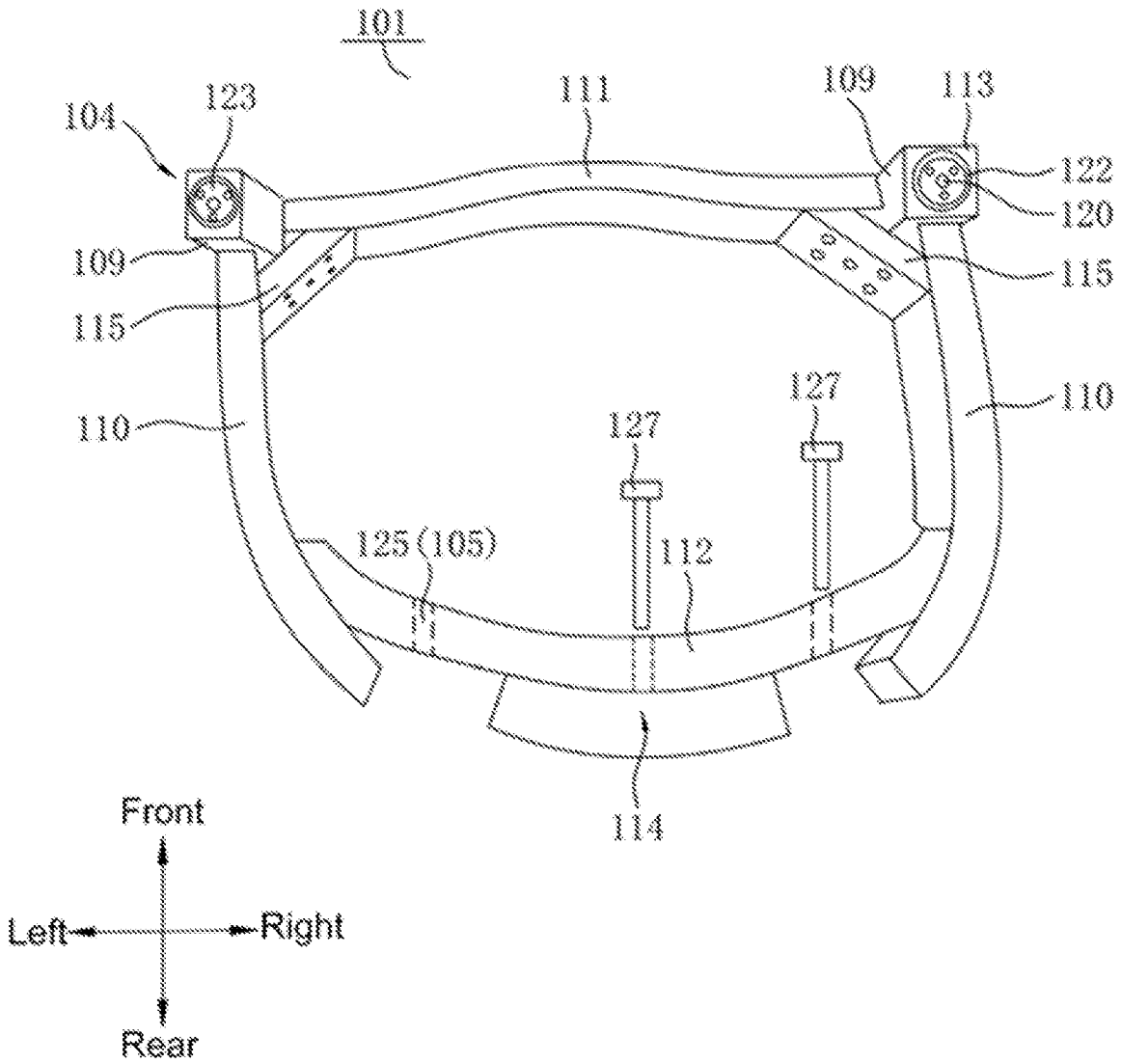
FIG. 2 is a schematic diagram of a seat component in FIG. 1 in an elevation direction.
Figure 3:
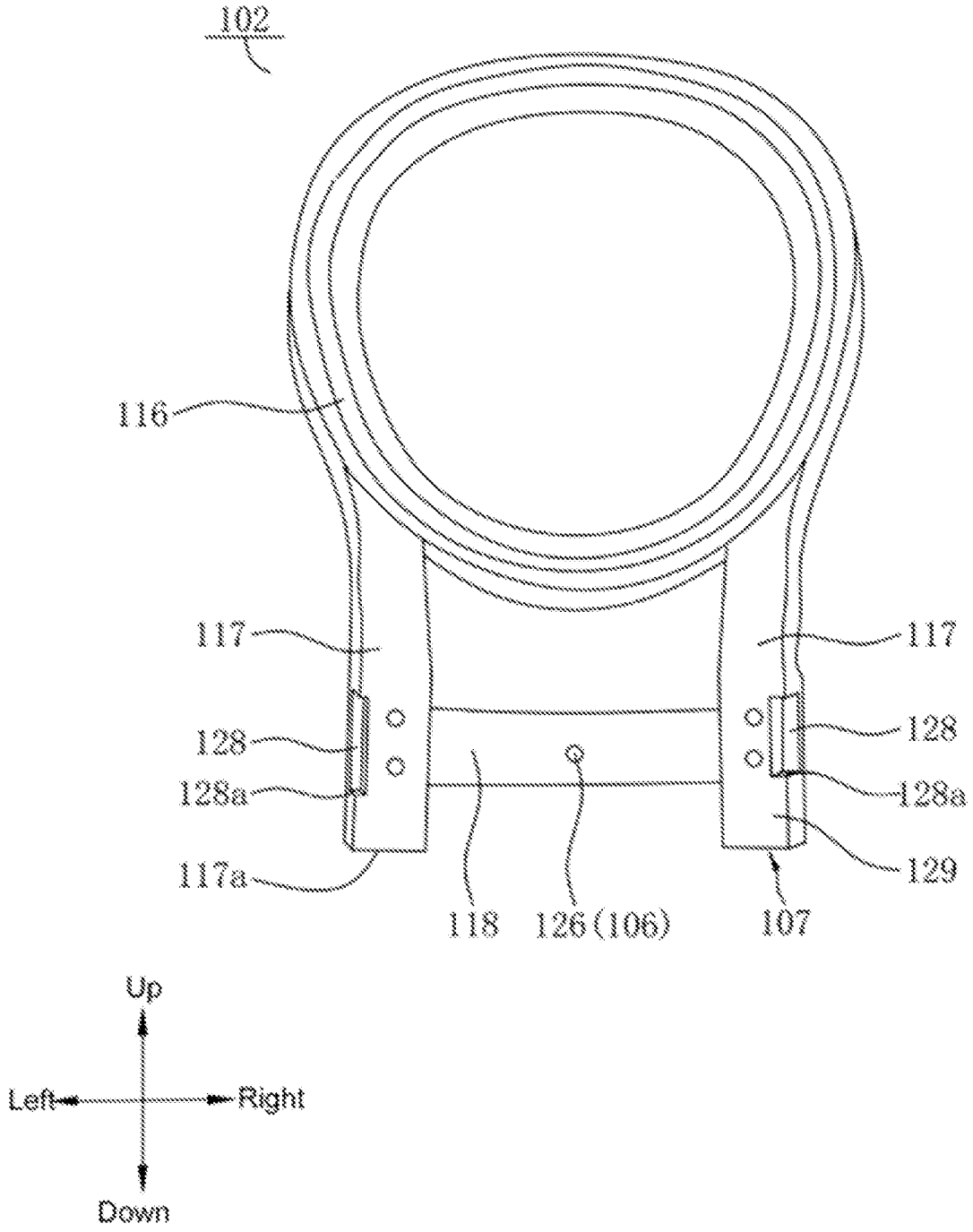
FIG. 3 is a schematic diagram of a backrest component in FIG. 1 in a main view direction.
Figure 4:
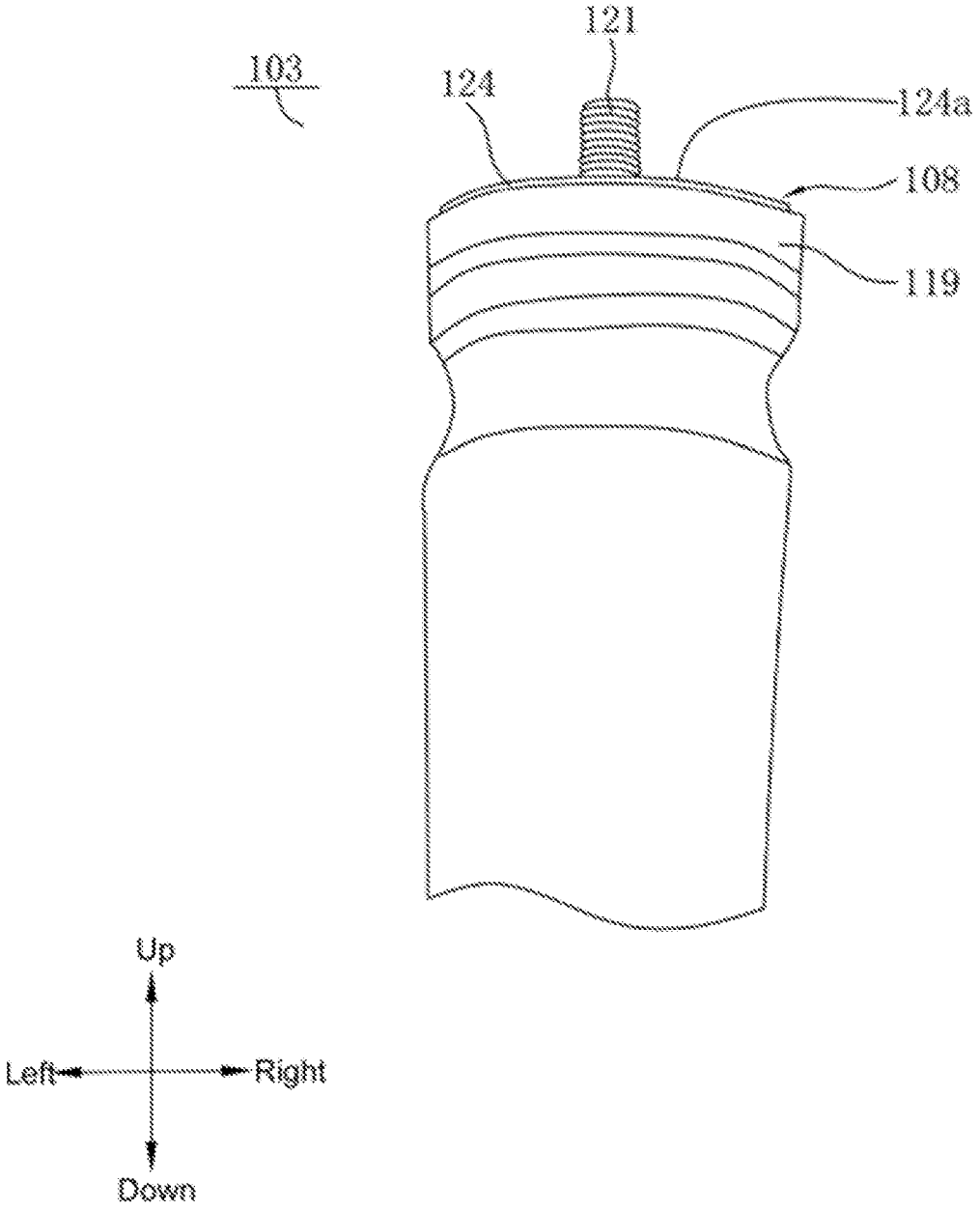
FIG. 4 is a schematic diagram of a main part of a supporting leg component.
Figure 5:
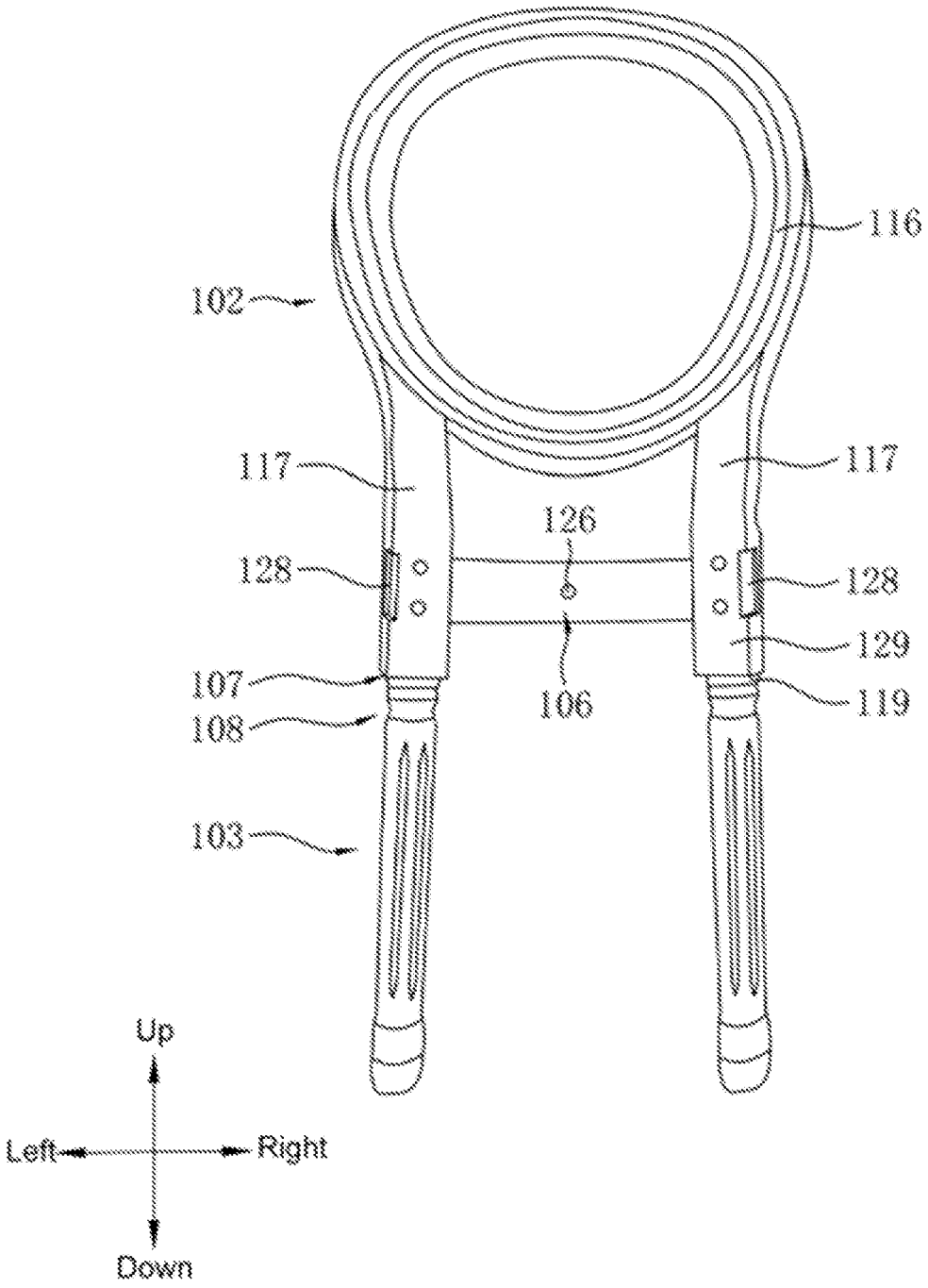
FIG. 5 is a schematic diagram of mounting the supporting leg component to the backrest component in the main view direction.
Figure 6:
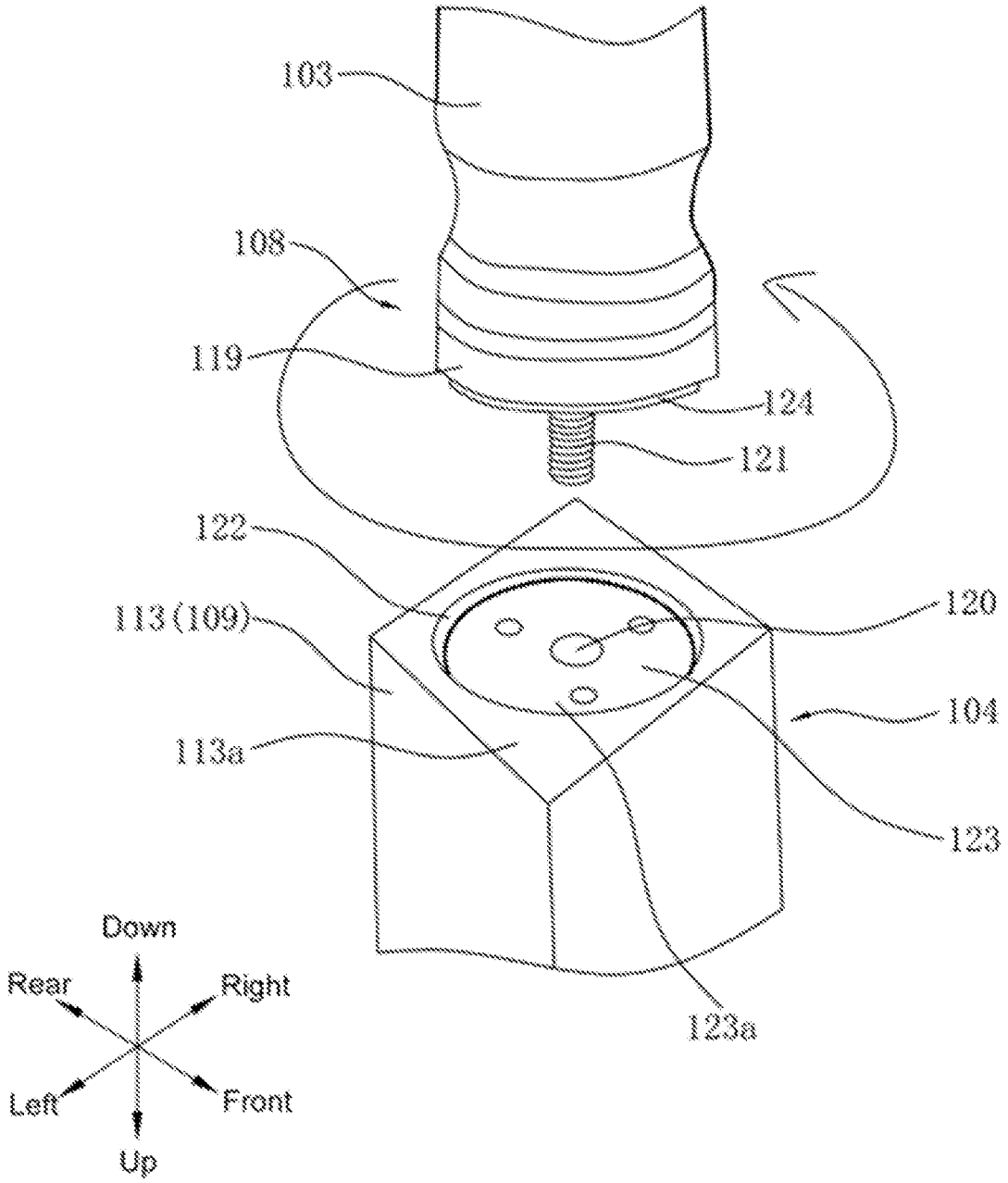
FIG. 6 is a schematic diagram showing mounting of the supporting leg component and a support rod of the seat component.

FIG. 1 is a schematic diagram of an embodiment of a chair. FIG. 2 is a schematic diagram of a seat component 101 in an elevation direction. FIG. 3 is a schematic diagram of a backrest component 102 in a main view direction. FIG. 4 is a schematic diagram of a main part of a supporting leg component 103. FIG. 5 is a schematic diagram of mounting the supporting leg component 103 to the backrest component 102 in the main view direction. FIG. 6 is a schematic diagram showing mounting of the supporting leg component 103 and a support rod 109 of the seat component 101. Moreover, FIG. 6 may also assist as a schematic diagram showing mounting of the supporting leg component 103 and an upright column 117 of the backrest component 102.

Referring to FIG. 1 to FIG. 6, and mainly referring to FIG. 1, FIG. 2, FIG. 3 and FIG. 4, a chair according to the first embodiment comprises: a seat component 101, a backrest component 102 and a plurality of supporting leg components 103. A lower portion of the seat component 101 is provided with a first mounting part 104, and a rear portion of the seat component 101 is provided with a second mounting part 105. A front side of a lower portion of the backrest component 102 is provided with a third mounting part 106, and a bottom side of the lower portion of the backrest component 102 is provided with a fourth mounting part 107. The backrest component 102 is detachably mounted to the rear portion of the seat component 101 through mutual cooperation of the second mounting part 105 and the third mounting part 106. An upper portion of each supporting leg component 103 is provided with a fifth mounting part 108. One part of the plurality of supporting leg components 103 is detachably mounted to the seat component 101 through mutual cooperation of the fifth mounting part 108 and the first mounting part 104. Another part of the plurality of supporting leg components 103 is detachably mounted to the backrest component 102 through mutual cooperation of the fifth mounting part 108 and the fourth mounting part 107.

The chair according to the first embodiment can reduce a packaging area in a disassembled state, and the assembly is easy. In some embodiments, for a known chair, the seat component 101 and the backrest component 102 are generally planar frames, while the supporting leg components 103 are generally cylindrical. In this embodiment, since the seat component 101, the backrest component 102 and the supporting leg components 103 can be detached from each other, the seat component 101 and the backrest component 102, which are generally planar and frame-shaped, may be stacked in a thickness direction during packaging, thereby reducing a height of the chair in the thickness direction and further reducing the packaging area. In addition, for the known chair, the backrest component 102 is usually arranged at the rear portion of the seat component 101, while the supporting leg component 103 is usually arranged at the lower portion of the seat component 101. In this embodiment, by providing the second mounting part 105 at the rear portion of the seat component 101, an installer can easily find a mounting position of the backrest component 102 and mount the backrest component 102 from the rear portion of the seat component 101. Further, by providing the third mounting part 106 at the lower portion of the seat component 101 and providing the fourth mounting part 107 at the bottom side of the lower portion of the backrest component 102, the installer can easily find mounting positions of the supporting leg components 103 and mount these supporting leg components 103 from the lower portion of the seat component 101. Therefore, even packaging and transporting the chair of this embodiment in a disassembled state may not affect the mounting and use of the chair by an operator.

The basic structures of various components of the chair will be explained in detail below. In addition, it should be noted that the seat component 101 and/or the backrest component 102 may be equipped with components (not given reference numerals) common to chairs, such as leather, sponge, cloth, etc., but in this embodiment, since the mounting structure of the chair is mainly explained, these components will be omitted in the following description and only mentioned when necessary.

(Seat Component 101)

Referring mainly to FIG. 2, the seat component 101 has a generally planar frame shape. The frame shape of the seat component 101 is not particularly limited, and various frame shapes such as a substantially rectangular frame shape, a substantially circular frame shape, and a frame shape with three straight sides and an arc-shaped fourth side may be cited. The seat component 101 may be spliced by structural components made of materials such as wood, metal and resin. Examples of the wood may comprise natural wood such as rubber, pine, birch and beech, and artificial wood such as artificial plywood and curved wood. Examples of the metal comprises aluminum, stainless steel, and the like. In addition, the seat component 101 may also be directly and integrally formed by these materials.

The following is an example of the seat component 101 being spliced by structural components made of wood, for example. In some embodiments, the seat component 101 comprises two support rods 109 respectively located on left and right sides, two first connecting rods 110 respectively located on the left and right sides, a second connecting rod 111 located on a front side and a third connecting rod 112 located on a rear side.

The two support rods 109 are arranged at intervals in a left-right direction. In the state of being connected to the seat component 101, the two support rods 109 are respectively located on the front side of the seat component 101. A distance between the two support rods 109 in the left-right direction is not particularly limited, but may be appropriately determined according to a support area of the seat component 101, for example, may be more than 30 cm and less than 60 cm. An entire cross section of the support rod 109 is generally rectangular (the example in the figure) or circular, and the support rod 109 may extend in an up-down direction.

A front end of the first connecting rod 110 located on the left side is connected to the support rod 109 also located on the left side. In addition, a front end of the first connecting rod 110 located on the right side is connected to the support rod 109 also located on the right side. The first connecting rods 110 located on the left and right sides are connected with the support rods 109 in the same way approximately, and the two first connecting rods 110 are bilaterally symmetrical relative to a center line of the seat component 101 in the left-right direction. Therefore, in the following, the first connecting rod 110 and the support rod 109 located on the left side are mainly taken as an example for illustration, and the first connecting rod 110 and the support rod 109 located on the right side may be mentioned when necessary.

In some embodiments, the front end of the first connecting rod 110 is connected to an upper position of a rear side portion of the support rod 109. The connection way of the first connecting rod 110 and the support rod 109 is not particularly limited, for example, bolt connection, mortise and tenon connection, nail connection, key connection, snap connection and the like may be adopted. In addition, the first connecting rod 110 and the support rod 109 may be connected during factory machining. Therefore, mounting work of a chair purchaser (installer) may be simplified. A length of the support rod 109 in the up-down direction is larger than a width of the first connecting rod 110 in the up-down direction, so that the lower portion of the support rod 109 protrudes downwards relative to the first connecting rod 110, and is formed with a first mounting seat 113 (described later) of the first mounting part 104 for mounting the supporting leg component 103. A shape of the first connecting rod 110 from the front end to a middle position in a front-rear direction is approximately linear. In addition, a shape of the first connecting rod 110 from the middle position to a rear end extends toward a right direction of the seat component 101 as the first connecting rod extends toward the rear. Similarly, a shape of the first connecting rod 110 located on the right side from a middle position to a rear end extends toward a left direction of the seat component 101 as the first connecting rod extends toward the rear. In addition, the rear end of the first connecting rod 110 on the left side and the rear end of the first connecting rod 110 on the right side are opposite along the left and right sides, so that a mounting cavity 114 (described later) for mounting the backrest component 102 is formed at the rear portion of the seat component 101.

The second connecting rod 111 extends substantially linearly. It should be noted that the second connecting rod 111 may become a part of design elements of the chair, so various decorative surfaces, curved surfaces, or the like, may be formed on an upper surface of the second connecting rod 111. Here, when a longitudinal direction of the second connecting rod 111 is much larger than a peripheral dimension of a cross section of the second connecting rod 111, it is considered that the second connecting rod 111 extends substantially linearly. The two ends of the second connecting rod 111 in the length direction (left-right direction) are connected to the support rods 109 located on the left and right sides respectively. Similarly, the connection way of the second connecting rod 111 and the support rod 109 is not particularly limited, and for example, bolt connection, mortise and tenon connection, nail connection, key connection, snap connection and the like, may be adopted. When connected to the support rod 109, a vertical height of the second connecting rod 111 is the same as that of the first connecting rod 110. Therefore, when the seat component 101 is formed, the first connecting rod 110 and the second connecting rod 111 can stably support people sitting on the seat component 101.

Further, in order to reinforce connection strength of the seat component 101, the seat component 101 may also comprise reinforcing blocks 115. For instance, two reinforcing blocks 115 are provided, wherein one is arranged beside the support rod 109 located on the left side, and connects the front end of the first connecting rod 110 located on the left and the left side of the second connecting bar 111 respectively; and the other one is arranged beside the support rod 109 located on the right side, and connects the front end of the first connecting rod 110 located on the right side and the right side of the second connecting rod 111 respectively. The front end of the first connecting rod 110 and the left end of the second connecting rod 111 may be respectively orthogonal to the support rod 109, and correspondingly, the reinforcing block 115 is approximately 45 degrees from the front end of the first connecting rod 110 and the left end of the second connecting rod 111. In order to further reinforce the strength of connecting the first connecting rod 110 and the second connecting rod 111 to the support rod 109, the reinforcing blocks 115 may be fixed to the first connecting rod 110 and the second connecting rod 111, for example, by bolts, nails or other connectors (no reference numerals are given), respectively. Therefore, by fixing the first connecting rod 110 and the second connecting rod 111 to the support rod 109 respectively, and pulling the first connecting rod 110 and the second connecting rod 111 by the reinforcing block 115 inside the support rod 109, the connection strength among the first connecting rod 110, the second connecting rod 111 and the support rod 109 can be greatly reinforced.

In a state of being connected to form the seat component 101, the third connecting rod 112 is located at the rear portion of the seat component 101. In some embodiments, the third connecting rod 112 extends in the left-right direction. A specific shape of the third connecting rod 112 may be determined by cooperating with a specific shape of the backrest component 102. For example, the third connecting rod 112 may have an arc shape protruding in the rear direction. In addition, the third connecting rod 112 may extend in a substantially straight line in the left-right direction. Two ends of the third connecting rod 112 are respectively connected with two first connecting rods 110 located on the left and right sides. The left end of the third connecting rod 112 is connected to a position of the first connecting rod 110 from the middle position in the front-rear direction to the rear end of the first connecting rod 110, that is, the rear end of the first connecting rod 110 protrudes rearward relative to the third connecting rod 112. Similarly, the rear end of the first connecting rod 110 located on the right side also protrudes rearward relative to the third connecting rod 112. Therefore, the rear ends of the first connecting rods 110 and the third connecting rods 112 located on the left and right sides together enclose the mounting cavity 114 that may be used for mounting the backrest component 102.

In addition, the first connecting rod 110, the second connecting rod 111, and the third connecting rod 112 are all formed in a rectangular frame shape in the state of being mounted to form the seat component 101. As a result, people sitting on the seat component 101 can be reliably supported.

(Backrest Component 102)

Referring to FIG. 3 and FIG. 5, the backrest component 102 has a generally planar frame shape. The frame shape of the seat component 101 is not particularly limited, and various frame shapes such as a substantially rectangular frame shape, a substantially circular frame shape, and a frame shape with three straight sides and an arc-shaped fourth side may be cited. The backrest component 102 may be spliced by structural members made of the same material as the seat component 101, for example. In addition, the backrest component 102 may also be directly and integrally formed by these materials.

In some embodiments, the backrest component 102 may comprise a body 116 and two upright columns 117. The body 116 of the backrest component 102 is used for the people sitting on the seat to lean on, etc. A shape of the body 116 is not particularly limited, for example, may be generally rectangular (a square is also regarded as a special rectangle), circular, elliptical (the shape shown in the figure), etc. The two upright columns 117 are located on the left and right sides of the backrest component 102 respectively, and are connected with a 1 lower portion of the body 116 respectively. In addition, the two upright columns 117 extend further downward relative to the lower portion of the body 116. A distance between the two upright columns 117 in the left-right direction is matched with a distance in the left-right direction of the rear portion of the seat component 101. In some embodiments, the two upright columns 117 are only required to make the whole backrest component 102 be at least partially clamped in the mounting cavity 114 of the seat component 101. The two upright columns 117 may be integrally formed with the body 116 by wood, and may also be connected by bolt connection, mortise and tenon connection, nail connection, key connection and snap connection. From the perspective of improving the strength of the backrest component 102 and the aesthetics of the backrest component 102, the two upright columns 117 may be integrally formed with the body 116 through wood processing.

In addition, in some embodiments, the backrest component 102 may comprise a fourth connecting rod 118 connecting the two upright columns 117. The fourth connecting rods 118 extends in the left-right direction and is connected to the inner sides of the two columns 117 respectively. Similarly, the fourth connecting rod 118 may be integrally formed with the body 116 and the upright column 117 by wood, and may also be connected by bolt connection, mortise and tenon connection, nail connection, key connection and snap connection.

(Supporting Leg Component 103)

Referring to FIG. 4, for example, four supporting leg components 103 may be provided, and the structures of the four supporting leg components 103 may be approximately the same as a whole, for example, from the perspective of facilitating the installer to mount. A cross section of the supporting leg component 103 may be rectangular column, round, etc.

The mutual cooperation structures of the chair for mounting will be described in detail below.

First, mounting structures of the seat component 101 and the supporting leg component 103 are explained.

Referring to FIG. 6, and with reference to FIG. 1, FIG. 2 and FIG. 4, two of the four supporting leg components 103 are mounted on the seat component 101. As described above, the lower portion of the seat component 101 is provided with the first mounting part 104, and the upper portion of each supporting leg component 103 is provided with the fifth mounting part 108. Some of the plurality of supporting leg components 103 are detachably mounted to the seat component 101 through mutual cooperation of the fifth mounting part 108 and the first mounting part 104. In some embodiments, the first mounting part 104 is disposed on the support rod 109, and in some embodiments, the first mounting part 104 may comprise the first mounting seat 113 arranged at the lower portion of the support rod 109, the first mounting seat 113 is integrally formed with the support rod 109 and protrudes downward relative to the first connecting rod 110, thereby facilitating the mounting of the supporting leg component 103. The fifth mounting part 108 comprises a mounting boss 119 arranged at an upper portion of the supporting leg component 103. For example, the mounting boss 119 is integrally formed on the upper portion of the supporting leg component 103. One of the first mounting seat 113 or the mounting boss 119 is provided with a first mounting hole 120 (threaded hole), and a first mounting bolt is provided at the other of the first mounting seat or the mounting boss 119, and the first mounting bolt 121 is mounted to the first mounting hole 120.

By embedding the first mounting bolt 121 in one of the first mounting seat 113 or the mounting boss 119, the first mounting bolt 121 can be directly fixed on the seat component 101 or the supporting leg component 103 in a delivery state, which can reduce the number of accessories requiring extra packaging, prevent these accessories from being lost, and facilitate mounting by the installer.

In addition, since the first mounting bolt 121 is embedded in one of the first mounting seat 113 or the mounting boss 119, when mounting the supporting leg component 103, the first mounting hole 120 and the first mounting bolt 121 may be directly aligned with each other without using other tools, so that the mounting can be realized by rotating without the installer to confirm the position or confirm specifications of different bolts, and the mounting difficulty of the installer can be reduced.

Furthermore, since a diameter of the supporting leg component 103 is larger than that of a common wrench, the installer can rotate the supporting leg component 103 forcefully (providing an enough torque) only by holding the supporting leg component 103 by hands during mounting, thereby ensuring that the first mounting bolt 121 and the first mounting hole 120 are installed in place.

Furthermore, since the first mounting seat 113 is formed on the support rod 109 of the seat component 101, and the support rod 109 extends in the up-down direction and protrudes from the first connecting rod 110 and the second connecting rod 111, the two support rods 109 of the seat component 101 can be easily machined during machining, thus ensuring the machining accuracy of the two support rods 109. For example, after the seat component 101 is spliced by the support rods 109 and the like, the first mounting seat 113 located at the lower portion of the support rod 109 can be further finished, so that the high accuracy of the first mounting seat 113 can be ensured. Therefore, there is no need for the installer to make additional adjustment according to a specific mounting situation at a mounting site, so the mounting difficulty of the installer can be further reduced.

In some embodiments, the first mounting seat 113 is provided with a first positioning hole 122, and the mounting boss 119 is cylindrical and is accommodated in the first positioning hole 122. In some embodiments, a cross section of the first positioning hole 122 is approximately circular, for example, and a cross section of the mounting boss 119 is also approximately circular. A diameter of the first positioning hole 122 is approximately the same as that of the mounting boss 119, or slightly larger than that of the mounting boss 119. Therefore, the mounting accuracy of the supporting leg component 103 can be improved, and the mounting difficulty of the installer can be reduced.

For example, when the first mounting bolt 121 is mounted to the first mounting hole 120, the supporting leg component 103 may swing relative to the support rod 109. In this case, by providing the first positioning hole 122 that can guide the mounting boss 119 of the supporting leg component 103, the swing of the supporting leg component 103 relative to the support rod 109 can be suppressed, and the positions of the first mounting bolt 121 and the first mounting hole 120 can be automatically corrected to prevent the first mounting bolt 121 from leaning relative to the first mounting hole 120.

In some embodiments, the first mounting hole 120 and the first positioning hole 122 are coaxially arranged in the first mounting seat 113, and the first mounting bolt 121 is embedded in the mounting boss 119 and coaxial with the mounting boss 119. In some embodiments, in order to improve the mounting strength of the first mounting hole 120, the first mounting part 104 may further comprise a first threaded seat 123. For example, the first threaded seat 123 is a metal component, and the first threaded seat 123 is cylindrical as a whole, and the first threaded seat 123 is coaxially provided with a threaded hole. The first threaded seat 123 is embedded in the first positioning hole 122, and the threaded hole coaxial with the first threaded seat 123 serves as the first mounting hole 120. Then, after being embedded into the first positioning hole 122, the threaded hole coaxial with the first threaded seat 123 and serving as the first mounting hole 120 is coaxial with the first positioning hole 122. The first threaded seat 123 may be further locked in the first positioning hole 122 by screws or the like after being embedded in the first positioning hole 122. Therefore, the first threaded seat 123 can be reliably fixed in the first mounting hole 120. The first threaded seat 123 (referred to as a first lower end face 123*a* for easy distinction) is flat, and a distance between a lower end face of the first threaded seat 123 and a lower end face of the first mounting seat 113 (referred to as a second lower end face 113*a* for easy distinction) is, for example, 5 cm to 10 cm after being embedded into the first positioning hole 122. Therefore, sufficient positioning space can be ensured in the first positioning hole 122. In addition, although it is explained that the distance between the lower end face of the first threaded seat 123 and the lower end face of the first mounting seat 113 is, for example, 5 cm to 10 cm, for the same seat component 101, for example, the distances between the second lower end faces 113*a* of the first mounting seats 113 of the two support rods 109 of the seat component 101 and the first lower end face 123*a* of the first threaded seat 123 installed in the first mounting hole 120 are equal.

In addition, the fifth mounting part 108 on the supporting leg component 103 may further comprise a second threaded seat 124. For example, the second threaded seat 124 is a metal component. The second threaded seat 124 may be cylindrical, and the second threaded seat 124 is coaxially provided with a screw serving as the first mounting bolt 121. The second threaded seat 124 is coaxially mounted (embedded) on the mounting boss 119. For example, the mounting boss 119 may be provided with a mounting hole (not shown), and the second threaded seat 124 is embedded in the mounting hole. An upper end face 124*a* of the second threaded seat 124 protrudes from the mounting boss 119 when being mounted in the mounting hole. The upper end face 124*a* of the second threaded seat 124 is, for example, a plane. Therefore, when the mounting boss 119 of the supporting leg component 103 is mounted into the first positioning hole 122, the upper end face 124*a* of the second threaded seat 124 of the mounting boss 119 and the lower end face (i.e., the first lower end face 123*a*) of the first threaded seat 123 can be attached.

The first mounting part 104 comprises the first threaded seat 123 embedded in the first positioning hole 122, and the fifth mounting part 108 comprises the second threaded seat 124 mounted on the mounting boss 119, and the supporting leg component 103 is mounted to the seat component 101 through the mutual cooperation (threaded connection) of the first threaded seat 123 and the second threaded seat 124, thereby improving the mounting accuracy of the supporting leg component 103 on the seat component 101. For example, the first threaded seat 123 and the second threaded seat 124 may be made of metal, thus ensuring the accuracy of the lower end face (i.e., the first lower end face 123*a*) of the first threaded seat 123 and the accuracy of the upper end face 124*a* of the second threaded seat 124. Therefore, when mounting the supporting leg component 103, it is only necessary to rotate the supporting leg component 103 and make the lower end face of the first threaded seat 123 and the upper end face of the second threaded seat 124 attach to each other. In addition, since the machining accuracy of the first mounting hole 120 and the first mounting bolt 121 can be ensured, the accuracy of mounting the supporting leg component 103 to the seat component 101 can be further improved.

In addition, the example that the first mounting bolt 121 is embedded in the mounting boss 119 and the first mounting hole 120 is provided in the first mounting seat 113 has been described above. However, it is not limited to this. For example, the first mounting bolt 121 may be embedded in the first mounting seat 113, and the first mounting hole 120 may be formed on the mounting boss 119. In some embodiments, for example, the first threaded seat 123 may be arranged on the mounting boss 119, and the second threaded seat 124 may be arranged on the first mounting seat 113.

Mounting structures of the seat component 101 and the backrest component 102 are explained below.

Referring to FIG. 2, FIG. 3 and FIG. 5, as mentioned above, the rear portion of the seat component 101 is provided with the second mounting part 105, and the front side of the lower portion of the backrest component 102 is provided with the third mounting part 106. The backrest component 102 is detachably mounted to the rear portion of the seat component 101 through the mutual cooperation of the second mounting part 105 and the third mounting part 106.

In some embodiments, the second mounting part 105 may comprise a plurality of through holes 125 arranged at the rear portion of the seat component 101. The third mounting part 106 may comprise a plurality of second mounting holes 126 arranged in front of the lower portion of the backrest component 102. In addition, the chair further includes a plurality of second mounting bolts 127, the second mounting bolts pass through the through holes 125 and are mounted to the second mounting holes 126, so that the backrest component 102 is mounted to the rear portion of the seat component 101. The second mounting hole 126 may be a threaded hole. In order to reliably mount the backrest component 102, the third mounting part 106 may comprise the plurality of second mounting holes 126. In order to improve the mounting strength, the second mounting holes 126 may be arranged on the upright columns 117 of the backrest component 102. For example, two second mounting holes 126 are arranged in both the two upright columns 117 of the backrest component 102. The two second mounting holes 126 on the upright columns 117 are spaced apart in the up-down direction. In addition, for example, the through hole 125 of the second mounting part 105 may be arranged in the third connecting rod 112 at the rear portion of the seat component 101. For example, the through hole 125 is arranged near an end portion of the third connecting rod 112 in the left-right direction, and the second mounting hole 126 of the backrest component 102 and the through hole 125 of the seat component 101 are matched with each other, so that the backrest component 102 and the seat component 101 can be easily locked through the second mounting bolt 127.

In addition, in order to make the backrest component 102 more closely adhere to the seat component 101, for example, a second mounting hole 126 may also be arranged at the middle in the left-right direction of the fourth connecting rod 118, and a through hole 125 may also be arranged at the middle in the left-right direction of the third connecting rod 112. Therefore, the backrest component 102 and the seat component 101 are also locked at the middle in the left-right direction by the second mounting bolt 127, so that the backrest component 102 can be more closely attached to the seat component 101.

By arranging the second mounting holes 126 on the two upright columns 117 of the backrest component 102 at intervals in the up-down direction, a bearing capacity of the backrest component 102 can be improved. For example, when the backrest component 102 is leaned, the backrest component 102 bears large torsion forces, and in some embodiments, these torsion forces are mainly concentrated on the upright columns 117 of the backrest component 102. In this embodiment, by extending the upright columns 117 in the up-down direction and arranging the second mounting holes 126 at intervals in the up-down direction, a torsion bearing capacity of the upright columns 117 can be improved.

In addition, since the second mounting bolt 127 locks the backrest component 102 and the seat component 101 in a direction of mutual mounting of the backrest component 102 and the seat component 101 (front-rear direction in the figure), the installer can easily judge the mounting position and the mounting method, thus reducing the mounting difficulty.

As described above, the rear end of the first connecting rod 110 located on the left side and the rear end of the first connecting rod 110 located on the right side are opposite along the left and right sides, and the mounting cavity 114 for mounting the backrest component 102 is formed at the rear portion of the seat component 101. The mounting cavity 114 is formed at the rear portion of the seat component 101, and at least part of the lower portion of the backrest component 102 is clamped in the mounting cavity 114.

Continuously referring to FIG. 3 and FIG. 5, In some embodiments, for example, mounting grooves 128 are arranged on the left and right sides of the lower portion of the backrest component 102, and the backrest component 102 is clamped in the mounting cavity 114 through the mounting grooves 128. The mounting grooves 128 are arranged, for example, outside the upright columns 117 on the left and right sides of the backrest component 102. Structures of the mounting grooves 128 of the two upright columns 117 are almost the same, and are thus explained here in a unified way and separately when necessary. When viewing from the side in the left-right direction, a shape of the mounting groove 128 is approximately U-shaped, and the mounting groove 128 penetrates the upright column 117 in the front direction. A width of the mounting groove 128 in the up-down direction is the same as that of the first connecting rod 110 of the seat component 101, or slightly larger than that of the second connecting rod 111. A depth of the mounting groove 128 in the front-rear direction is approximately the same as or slightly larger than a distance between the rear end of the first connecting rod 110 of the seat component 101 and a rear surface of the third connecting rod 112 of the seat component 101. In addition, a distance between a lower interior face 128*a* of the mounting groove 128 and a lower end face (also referred to as a third lower end face 117*a* for easy distinction) of the upright column 117 is the same as a distance between a lower surface of the first connecting rod 110 and the lower end face (i.e., the second lower end face 113*a* of the first mounting seat 113) of the support rod 109. In addition, the distance between the mounting grooves 128 at the left and right sides in the left-right direction is the same as or slightly larger than a relative distance between the rear ends of the first connecting rods 110 located in the left and right sides in the left-right direction. Therefore, when the backrest component 102 is mounted to the mounting cavity 114 of the seat component 101, the rear ends of the first connecting rods 110 on the left and right sides of the seat component 101 can be inserted into the mounting grooves 128 of the upright columns 117 on the left and right sides.

By forming the mounting cavity 114 in the rear portion of the seat component 101 and the mounting grooves 128 in the backrest component 102, and inserting the rear end of the first connecting rod 110 of the seat component 101 into the mounting groove 128 when the backrest component 102 is mounted in the mounting cavity 114, the mounting difficulty of the backrest component 102 can be reduced and the mounting efficiency can be improved. In some embodiments, with this mounting method, a mounting reference can be formed on the seat component 101, and the mounting method of the backrest component 102 can be unique, so that the mounting failure caused by the wrong operation of the installer can be avoided. For example, on the seat component 101 which is roughly formed in a frame shape, only the rear portion of the seat component 101 has a region (i.e., the mounting cavity 114) with a shape similar to that of the backrest component 102. In this case, the installer can quickly determine the mounting position. In addition, the backrest component 102 can be inserted into the mounting cavity 114 of the seat component 101 only at the position with the mounting groove 128, so that the wrong operation of the installer can be avoided, thereby reducing the mounting difficulty of the backrest component 102 and improving the mounting efficiency.

In addition, since the rear ends of the first connecting rods 110 of the seat component 101 are respectively inserted into the mounting grooves 128, the seat component 101 and the backrest component 102 can be pre-positioned and pre-fixed before the second mounting bolts 127 are mounted.

Therefore, it is convenient for the installer to mount the second mounting bolt 127 without other assistants, and the mounting efficiency can be further improved.

Further, since the mounting groove 128 is processed in the factory in advance, it is possible to ensure that the distance between the lower interior face 128*a* of the mounting groove 128 and the lower end surface (third lower end surface 117*a*) of the upright column 117 is the same as the distance between the lower surface of the first connecting rod 110 and the lower end surface of the support rod 109. In this way, after the supporting leg component 103 are mounted on the support rods 109 of the seat component 101 and the upright columns 117 at the lower portion of the backrest component 102, the heights of various positions of the seat component 101 supported by the supporting leg components 103 can be ensured to be consistent without any additional adjustment, thus simplifying the mounting work of the installer and improving the mounting efficiency.

In addition, by making the width of the mounting groove 128 in the up-down direction the same as the width of the rear end of the first connecting rod 110 of the seat component 101 in the up-down direction, the bearing capacity of the upright column 117 can be greatly increased, and a force applied to the second mounting bolt 127 can be reduced. For example, when the backrest component 102 is leaned, a torsional force borne by the backrest component 102 is mainly concentrated on the upright column 117 of the backrest component 102, and in some embodiments, the torsional force may be concentrated on the second mounting bolt 127. In this embodiment, the width of the mounting groove 128 in the up-down direction is the same as that of the rear end of the first connecting rod 110 of the seat component 101, and the rear end of the first connecting rod 110 is inserted into the mounting groove 128, so that the backrest component 102 can be supported by the first connecting rod 110, and a part of the torsional force borne by the backrest component 102 can be transferred to the first connecting rod 110. Therefore, the entire force borne by the backrest component 102 and the seat component 101 can be more uniform.

Mounting structures of the supporting leg component 103 and the backrest component 102 are explained below.

Referring to FIG. 3 and FIG. 5 and with reference to FIG. 6, the other two of the four supporting leg components 103 are mounted on the backrest component 102. As described above, the fourth mounting portion 107 is arranged on a bottom side of the lower portion of the backrest component 102. An upper portion of the supporting leg component 103 is provided with a fifth mounting part 108. Another part of the plurality of supporting leg components 103 is detachably mounted to the backrest component 102 through mutual cooperation of the fifth mounting part 108 and the fourth mounting part 107. In some embodiments, the fourth mounting part 107 is arranged on the upright column 117 of the backrest component 102, and in some embodiments, the fourth mounting part 107 may comprise a second mounting seat 129 arranged at the lower portion of the upright column 117. The second mounting seat 129 is integrally formed with the upright column 117, and in a state of being mounted to the seat component 101, the second mounting seat 129 protrudes downward relative to the first connecting rod 110, and a downward protrusion distance of the second mounting seat 129 relative to the first connecting rod 110 is the same as a downward protrusion distance of the first mounting seat 113 of the support rod 109, thereby ensuring that the mounting heights of the supporting leg components 103 are consistent. One of the second mounting seat 129 and the mounting boss 119 of the supporting leg component 103 is provided with a third mounting hole (threaded hole, not separately labeled with reference numeral, referring to the first mounting hole 120), and the other is embedded with a third mounting bolt (not separately labeled with reference numeral, referring to the first mounting bolt 121). The third mounting bolt is mounted to the third mounting hole.

By detachably mounting the supporting leg component 103 to the backrest component 102, the length of the backrest component 102 in the up-down direction can be reduced, thereby reducing the packaging area.

By embedding the third mounting bolt in one of the second mounting seat 129 and the mounting boss 119, the third mounting bolt can be directly fixed on the backrest component 102 or the supporting leg component 103 in a delivery state, which can reduce the number of accessories requiring extra packaging, prevent these accessories from being lost, and facilitate mounting by the installer.

In addition, since the third mounting bolt is embedded in one of the second mounting seat 129 and the mounting boss 119, when mounting the supporting leg component 103, the third mounting hole between the supporting leg component 103 and the second mounting seat 129, and the third mounting bolt may be directly aligned with each other without using other tools, so that the mounting can be realized by rotating without the installer to confirm the position or confirm specifications of different bolts, and the mounting difficulty of the installer can be reduced.

Furthermore, since the second mounting seat 129 is formed on the upright column 117 of the backrest component 102, the two upright columns 117 can be easily machined during machining, thereby ensuring the machining accuracy of the two upright columns 117. Therefore, there is no need for the installer to make additional adjustment according to the specific mounting situation at the mounting site, so the mounting difficulty of the installer can be further reduced.

In addition, the second mounting seat 129 may be provided with a second positioning hole (not separately labeled with reference numeral, referring to the first positioning hole 122 for reference), and correspondingly, the mounting boss 119 of the supporting leg component 103 is cylindrical and is accommodated in the second positioning hole. A structure of the second mounting seat 129 may be designed with reference to the structure of the first mounting seat 113. For example, the third mounting hole and the second positioning hole may be coaxially arranged on the second mounting seat 129, and the third mounting bolt is embedded in the mounting boss 119 and coaxial with the mounting boss 119 (it should be noted that the third mounting bolt and the first mounting bolt 121 may be the same component in the case of being embedded in the mounting boss 119 of the supporting leg component 103). Similarly, in order to improve the mounting strength of the third mounting hole, the fourth mounting part 107 may also comprise a threaded seat like the first threaded seat 123.

Similarly, the third mounting bolt may be embedded in the second mounting seat 129, and the supporting leg component 103 has the same structure as the supporting leg component 103 connected to the support rod 109.

In addition, although the example that two supporting leg components 103 are mounted to the seat component 101 and two supporting leg components 103 are mounted to the backrest component 102 has been described above, it is not limited to this. For example, the chair of the second embodiment is different from the chair of the first embodiment in that all the supporting leg components 103 are mounted to the lower portion of the seat component 101. That is, the chair of the second embodiment may comprise the seat component 101, the backrest component 102, and the plurality of supporting leg components 103 (for example, four). The lower portion of the seat component 101 is provided with the first mounting part 104, and the rear portion of the seat component 101 is provided with the second mounting part 105. The front side of the lower portion of the backrest component 102 is provided with the third mounting part 106, and the backrest component 102 is detachably mounted to the rear portion of the seat component 101 through the mutual cooperation of the second mounting part 105 and the third mounting part 106. The upper portion of the supporting leg component 103 is provided with the fifth mounting part 108, and the plurality of supporting leg components 103 are detachably mounted to the seat component 101 through the mutual cooperation of the fifth mounting part 108 and the first mounting part 104.

The chair according to the second embodiment can also reduce the packaging area in the disassembled state, and the assembly is easy.

In addition, as for the seat component 101 of the chair of the second embodiment, the number of the support rods 109 may be changed into four in the seat component 101 of the chair of the first embodiment, and the other components, such as the first connecting rod 110, may be adaptively changed according to the structure of the support rod 109.

In the description of this specification, the descriptions to the reference terms "one embodiment", "some embodiments", "illustrative embodiments", "examples", "specific examples" or "some examples" mean that the specific features, structures, materials or characteristics described in connection with this embodiment or example are included in at least one embodiment or example of the embodiments. In the specification, the schematic representation of the above terms does not necessarily mean the same embodiment or example. Moreover, the specific features, structures, materials or characteristics described may be combined in any one or more embodiments or examples in a suitable manner.

Although the examples of the embodiments have been shown and described, those of ordinary skills in the art should understand that: various changes, amendments, substitutions and modifications can be made to these embodiments without departing from the principles and purposes of the embodiments, and the scope of the embodiments is limited by the claims and equivalents thereof.

What is claimed is:

1. A chair, comprising:

a seat component, wherein first mounting parts are provided at a lower portion of the seat component, and a second mounting part is provided at a rear portion of the seat component;

a backrest component, wherein a third mounting part is provided at a front side of a lower portion of the backrest component, fourth mounting parts are provided at a bottom side of the lower portion of the backrest component, and the backrest component is detachably mounted to the rear portion of the seat component through mutual cooperation of the second mounting part and the third mounting part; and a plurality of supporting leg components, wherein a fifth mounting part is provided at an upper portion of each supporting leg component, one or more of the plurality of supporting leg components is detachably mounted to the seat component through mutual cooperation of its respective fifth mounting part and a first mounting part, and another one or more of the plurality of supporting leg components is detachably mounted to the backrest component through mutual cooperation of its respective fifth mounting part and a fourth mounting part;

wherein the first mounting part comprises a first mounting seat, and the fifth mounting part comprises a mounting boss; and a first mounting hole is provided at one of the first mounting seat or the mounting boss, a first mounting bolt is provided at the other of the first mounting seat or the mounting boss, and the first mounting bolt is mounted to the first mounting hole.

2. The chair of claim 1, wherein the first mounting seat is provided with a first positioning hole, and the mounting boss is cylindrical and is accommodated in the first positioning hole.

3. The chair of claim 2, wherein the first mounting hole and the first positioning hole are coaxially arranged in the first mounting seat, and the first mounting bolt is arranged at the mounting boss and coaxial with the mounting boss.

4. The chair of claim 3, wherein the first mounting part further comprises a first threaded seat, the first threaded seat is coaxially provided with a threaded hole serving as the first mounting hole, and the first threaded seat is embedded into the first positioning hole;

the fifth mounting part comprises a second threaded seat, the second threaded seat is coaxially provided with a screw serving as the first mounting bolt, and the second threaded seat is embedded in the mounting boss; and, when the mounting boss is accommodated in the first positioning hole, an end face of the first threaded seat is attachable to an end face of the second threaded seat.

5. The chair of claim 1, wherein the second mounting part comprises a plurality of through holes arranged at the rear portion of the seat component;

the third mounting part comprises a plurality of second mounting holes arranged in front of the lower portion of the backrest component; and the chair further comprises a plurality of second mounting bolts, the second mounting bolts pass through the through holes and are mounted to the second mounting holes, so that the backrest component is mounted to the rear portion of the seat component.

6. The chair of claim 5, wherein a mounting cavity is formed at the rear portion of the seat component, and at least part of the lower portion of the backrest component is clamped in the mounting cavity.

7. The chair of claim 5, wherein each fourth mounting part comprises a second mounting seat arranged at the lower portion of the backrest component, and the fifth mounting part comprises a mounting boss; and a third mounting hole is provided at one of the second mounting seat or the mounting boss, and a third mounting bolt is provided at the other of the second mounting seat or the mounting boss, and the third mounting bolt is mounted to the third mounting hole.

8. The chair of claim 1, wherein a mounting cavity is formed at the rear portion of the seat component, and at least part of the lower portion of the backrest component is clamped in the mounting cavity.

9. The chair of claim 8, wherein a mounting groove is provided at the lower portion of the backrest component, and the backrest component is clamped in the mounting cavity through the mounting groove.

10. The chair of claim 1, wherein the fourth mounting part comprises a second mounting seat arranged at the lower portion of the backrest component, and the fifth mounting part comprises a mounting boss; and a third mounting hole is provided at one of the second mounting seat or the mounting boss, and a third mounting bolt is provided at the other of the second mounting seat or the mounting boss, and the third mounting bolt is mounted to the third mounting hole.

11. The chair of claim 10, wherein the second mounting seat is provided with a second positioning hole, and the mounting boss is cylindrical and is accommodated in the second positioning hole.

12. The chair of claim 11, wherein the third mounting hole and the second positioning hole are coaxially arranged in the second mounting seat, and the third mounting bolt is arranged at the mounting boss and coaxial with the mounting boss.

13. A chair, comprising:

a seat component, wherein first mounting parts are provided at a lower portion of the seat component, and a second mounting part is provided at a rear portion of the seat component;

a backrest component, wherein a third mounting part is provided at a front side of a lower portion of the backrest component, and the backrest component is detachably mounted to the rear portion of the seat component through mutual cooperation of the second mounting part and the third mounting part; and a plurality of supporting leg components, wherein a fifth mounting part is provided at an upper portion of each supporting leg component, and each of the plurality of the supporting leg components is detachably mounted to the seat component through mutual cooperation of its respective the fifth mounting part and a first mounting part;

wherein a mounting cavity is formed at the rear portion of the seat component, and at least part of the lower portion of the backrest component is clamped in the mounting cavity;

wherein a mounting groove is provided at the lower portion of the backrest component, and the backrest component is clamped in the mounting cavity through the mounting groove.

* * * * *